US006971930B2

(12) United States Patent
Uraki et al.

(10) Patent No.: US 6,971,930 B2
(45) Date of Patent: Dec. 6, 2005

(54) ENGINE CONTROL UNIT

(75) Inventors: Mamoru Uraki, Wako (JP); Hideki Sugiyama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/827,939

(22) Filed: Apr. 19, 2004

(65) Prior Publication Data

US 2005/0239350 A1 Oct. 27, 2005

(30) Foreign Application Priority Data

Apr. 23, 2003 (JP) ..... 2003-118354
Feb. 20, 2004 (JP) ..... 2004-045100

(51) Int. Cl.[7] ..... B63B 21/14
(52) U.S. Cl. ..... 440/1; 440/87
(58) Field of Search ..... 440/1, 84, 87, 440/38–47

(56) References Cited

U.S. PATENT DOCUMENTS 6,390,862 B1 * 5/2002 Eichinger ..... 440/1
6,390,869 B2 * 5/2002 Korenjak et al. ..... 440/88 R
6,508,680 B2 * 1/2003 Kanno ..... 440/1
6,551,152 B2 4/2003 Matsuda et al.
6,709,302 B2 * 3/2004 Yanagihara ..... 440/1
6,733,350 B2 * 5/2004 Iida et al. ..... 440/84
6,796,289 B2 * 9/2004 Uraki et al. ..... 123/406.5

FOREIGN PATENT DOCUMENTS

JP 2002-87390 3/2002

* cited by examiner

*Primary Examiner*—Sherman Basinger
(74) *Attorney, Agent, or Firm*—Hamre, Schumann, Mueller & Larson, P.C.

(57) ABSTRACT

To provide an engine control unit that can easily realize reacceleration in a jet propulsion boat. In a controller mounted in a jet propulsion boat that jets water pressurized and accelerated by a water jet pump from a rear jet and is propelled by its reaction, in case a throttle angle of an engine narrows in a state in which the speed of the engine that drives the water jet pump is equal to or exceeds a predetermined value, advance angle control is made over the ignition timing of the engine.

3 Claims, 7 Drawing Sheets

(PRIOR ART)

ENGINE CONTROL UNIT

CROSS REFERENCE TO RELATED APPLICATIONS

This application claims priority to Japanese Patent Applications No. 2003-118354 filed on Apr. 23, 2003 and No. 2004-045100 filed Feb. 20, 2004.

FIELD OF THE INVENTION

The present invention relates to an engine control unit of a jet propulsion boat propelled by jetting water pressurized and accelerated by a water jet pump, otherwise commonly known as a personal water craft.

BACKGROUND OF THE INVENTION

In a conventional type water jet bicycle, when a throttle (TH) angle of an engine which drives a water jet pump is changed, the speed of the engine is controlled in accordance with the change (for example, refer to Japanese Patent No. 2002-87390).

For example, when a throttle lever is operated and a throttle is turned from a closed state into an open state, an engine control unit (ECU) determines engine speed corresponding to a throttle angle in the state based upon a value measured by another sensor and makes control over the engine speed.

When the throttle is turned from the open state into the closed state, the engine control unit similarly determines engine speed corresponding to the throttle angle in the state and controls the engine speed.

This state will be described using a personal water craft in which a power booster (a turbocharger) is provided to an engine that drives a water jet pump.

As shown in FIG. 5, the y-axis shows a value of each parameter such as engine speed, a throttle angle, boost pressure and ignition timing and a value on the upside of the y-axis is higher. The x-axis shows time.

In case as shown in FIG. 5, a throttle (TH) angle of the engine is held at a predetermined value or more for fixed time, the engine speed is held in a state of revolution (6400 rpm in FIG. 5) equal to or exceeding a predetermined value for fixed time in accordance with this. When a throttle angle of the engine rapidly narrows in short time in this state, the engine speed similarly rapidly decreases. The boost pressure of the turbocharger rapidly decreases as the engine speed decreases in a slight time lag behind the engine speed and the ignition timing of engine fuel is set to a value corresponding to decreased engine speed.

As described above, when the throttle is once closed, a throttle angle narrows and even if engine speed is held high immediately before, the engine speed decreases in accordance with the rapid closing of the throttle.

Therefore, even if a rider restores the throttle to full throttle acceleration to accelerate again immediately after, the engine speed already rapidly decreases and the ignition timing also lags. Therefore, a problem that the responsibility of the boost pressure of the turbocharger is not satisfactory and it takes time for the engine speed to reach a desired value again occurs.

BRIEF SUMMARY OF THE INVENTION

The object of the invention is to provide an engine control unit that can easily realize reacceleration in a jet propulsion boat.

The invention includes a jet propulsion boat that has an engine control unit capable of advance angle control over the ignition timing of the engine when a throttle angle of the engine narrows in a state in which the speed of an engine is equal to or exceeds a predetermined value.

As advance angle control is made over the ignition timing of the engine in case a throttle of the engine is rapidly closed when the speed of the engine that drives the water jet pump is in a state of revolution equal to or exceeding the predetermined value. Accordingly, the rapid decrease of the engine speed can be inhibited when the engine speed is held high immediately before.

According to the invention, as the rapid decrease of the engine speed is inhibited when the engine speed is held high immediately before, therefore, reacceleration can be easily realized.

DETAILED DESCRIPTION OF THE INVENTION

Figure 1:
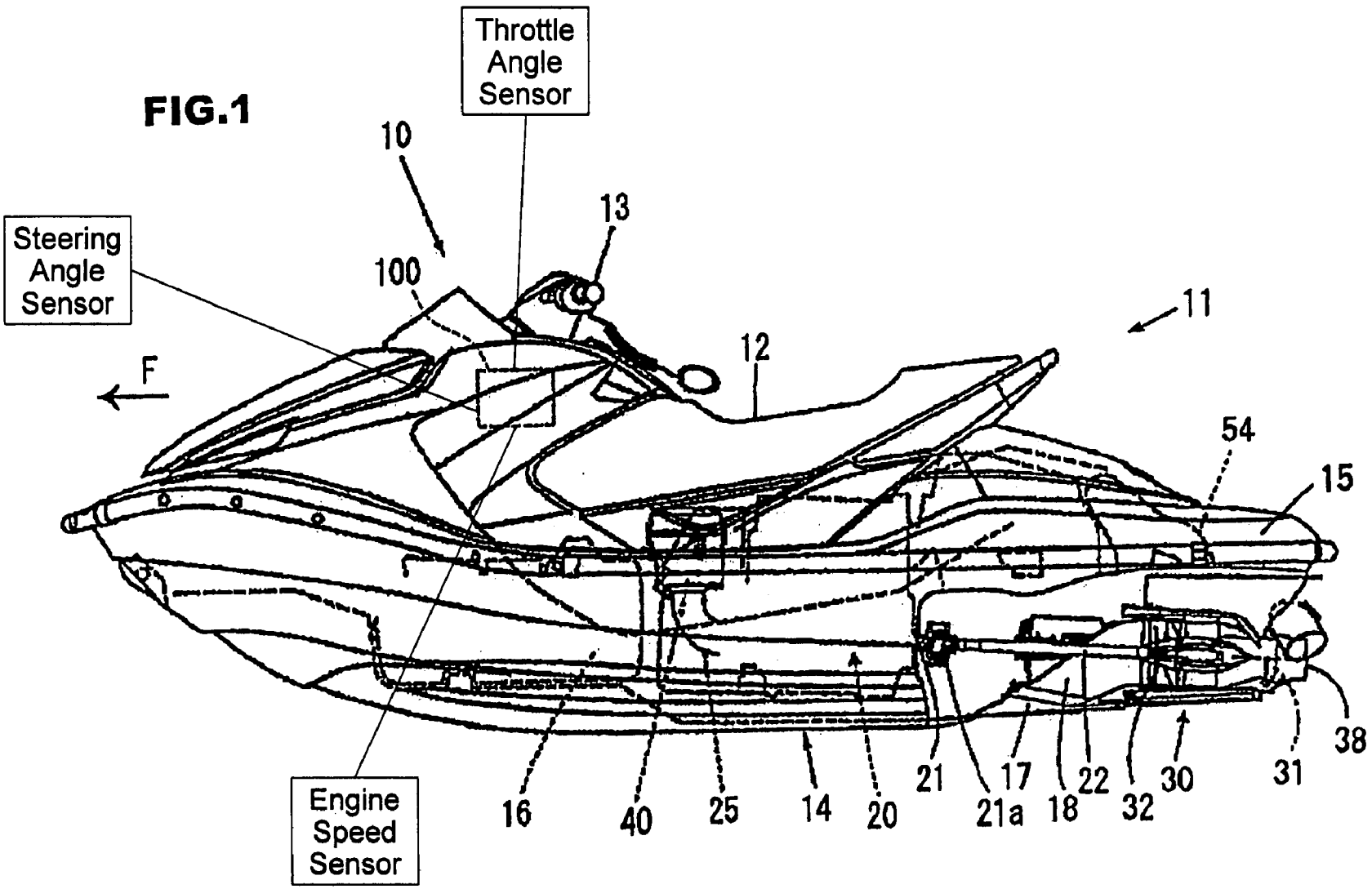
FIG. 1 is a side view a part of which is cut out showing a jet propulsion boat mounting the engine control unit equivalent to this embodiment.
Figure 2:
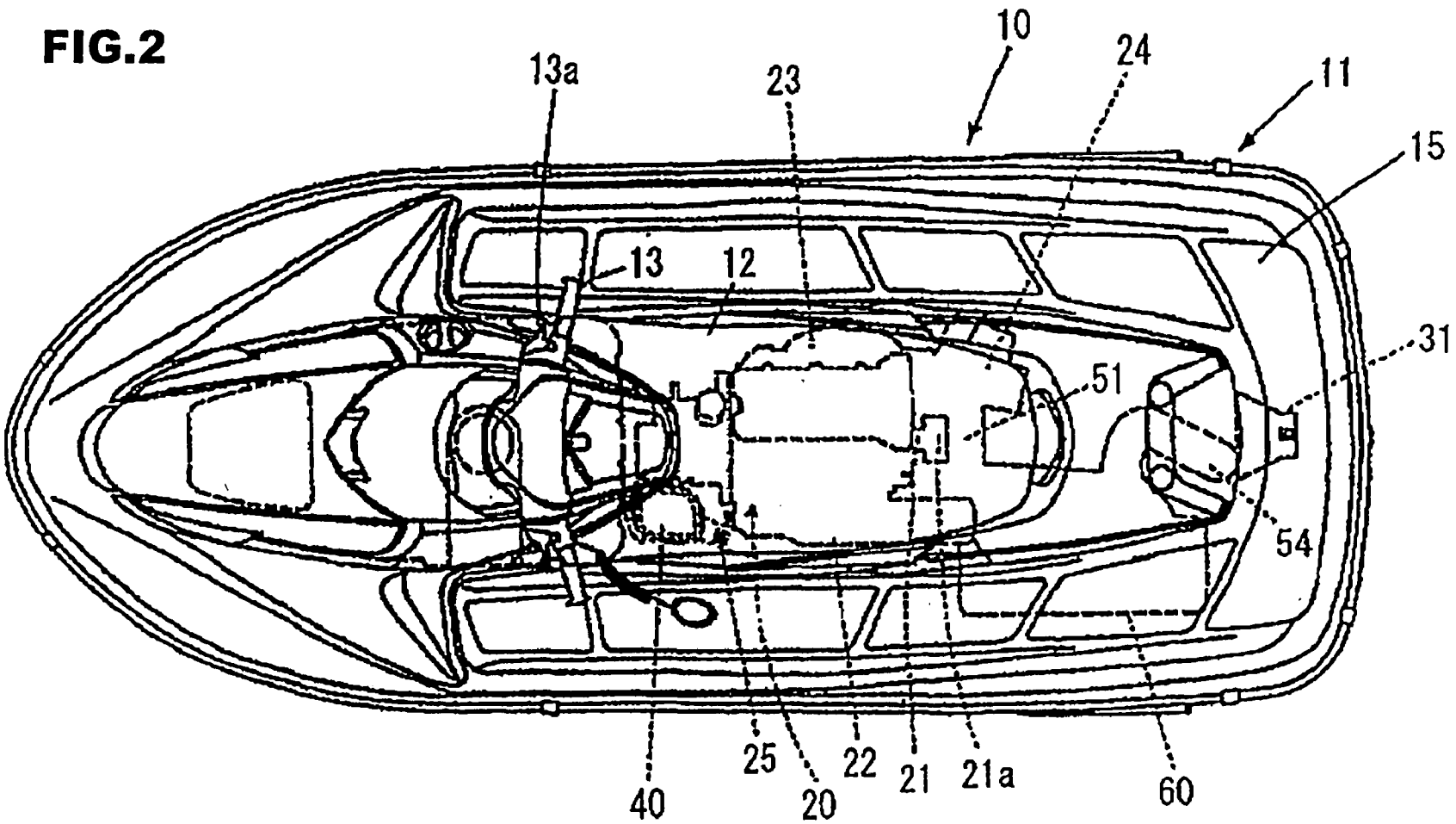
FIG. 2 is a plan showing the same jet propulsion boat.

Referring to the drawings, one embodiment of an engine control unit according to the invention will be described below. FIG. 1 is a side view a part of which is cut out showing a jet propulsion boat mounting the engine control unit equivalent to this embodiment and FIG. 2 is a plan showing the same boat.

As shown in these drawings (mainly FIG. 1), the jet propulsion boat 10, otherwise commonly known as a personal water craft, is a saddle-type small-sized boat, a crew sits on a seat 12 on the body 11, and the output of an engine 20 is adjusted by gripping and operating a steering handlebar 13 with a throttle lever and adjusting an opening of a throttle valve (not shown) of the engine 20.

The body of the boat 11 has floating structure acquired by bonding a hull 14 and a deck 15 and forming space 16 inside. In the space 16, the engine 20 is mounted above the hull 14 and a water jet pump 30 as propelling means driven by the engine 20 is provided to the rear of the hull 14.

The water jet pump 30 is provided with an impeller 32 arranged in a duct 18 extended from an intake 17 open to the bottom to a deflector 38 via an exhaust nozzle 31 open to the rear end of the body, and a shaft (a drive shaft) 22 for driving the impeller 32 is coupled to the output shaft 21 of the engine 20 via a coupler 21*a*.

Therefore, when the impeller 32 is rotated by the engine 20 via the coupler 21*a* and the shaft 22, water taken in from the intake 17 is jetted from the exhaust nozzle 31 via the deflector 38 and hereby, the body 11 is propelled.

The number of revolutions of the engine 20, that is, propelling force by the water jet pump 30 is operated by the turning operation of the throttle lever 13*a* (see FIG. 2) of the steering handlebar 13. The deflector 38 is linked with the steering handlebar 13 via operating wire not shown, is turned by the operation of the handlebar 13 and hereby, a course of the body 11 can be changed.

Figure 3:
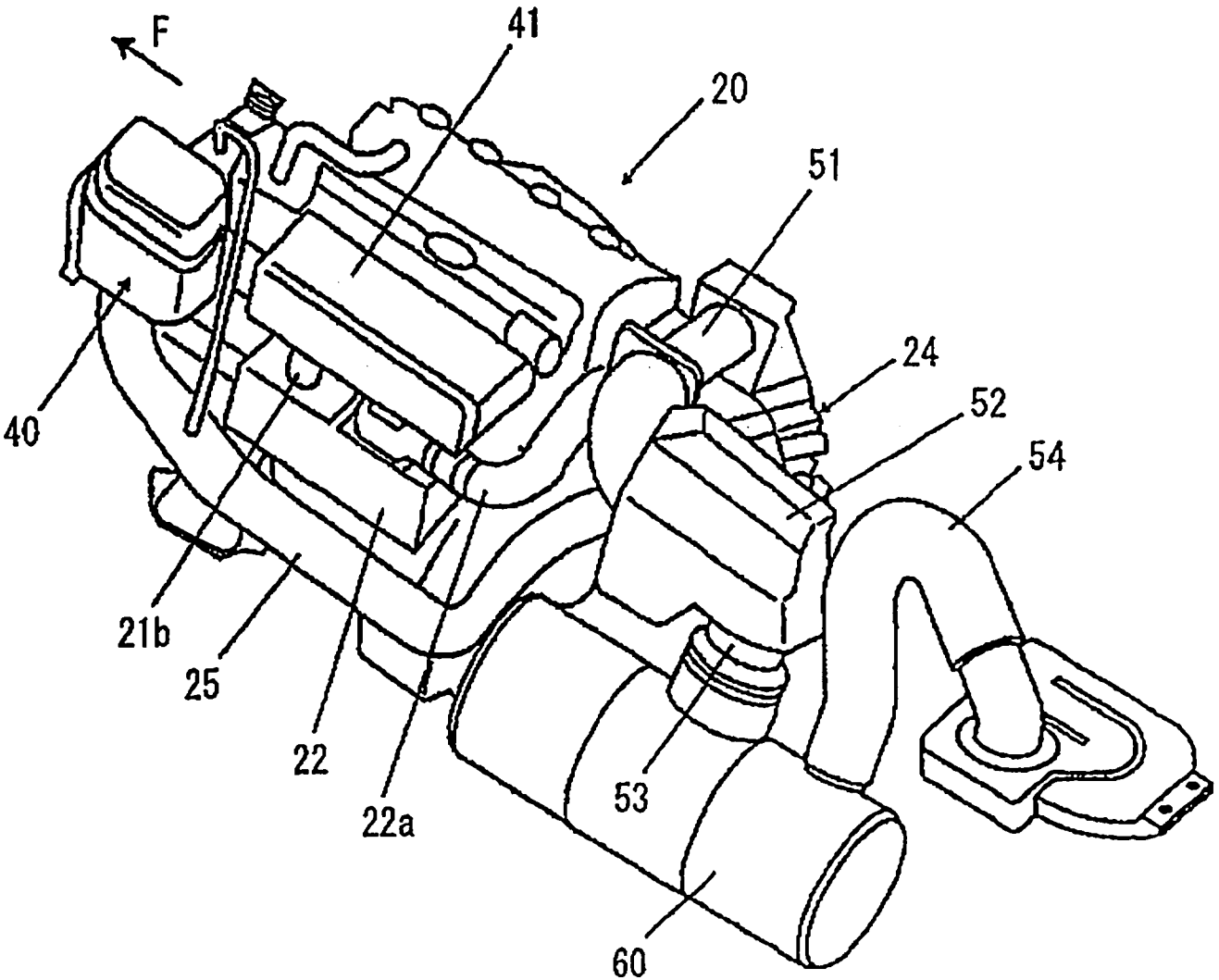
FIG. 3 is a schematic perspective view mainly showing an engine and a turbocharger.

FIG. 3 is a schematic perspective view mainly showing the engine 20.

The engine 20 is a DOHC-type in-line four-cylinder dry sump-type four-cycle engine and its crankshaft (see the output shaft 21 shown in FIG. 1) is arranged along the longitudinal direction of the body 11.

As shown in FIGS. 1 to 3, a surge tank 41 and an inter-cooler 22 are connected and arranged on the left side of the engine 20 in the traveling direction F of the body 11 and an exhaust manifold 23 is arranged on the right side of the engine 20.

A turbocharger 24 for feeding compressed intake air to the engine 20 is arranged at the back of the engine 20 and an air cleaner case 40 for taking new air in the turbocharger 24 via a pipe 25 is arranged in front of the engine 20.

An exhaust outlet of the exhaust manifold 23 (see FIG. 2) is connected to a turbine of the turbocharger 24. Besides, the inter-cooler 22 is connected to a compressor of the turbocharger 24 via a pipe 22*a* and the surge tank 41 is connected to the inter-cooler 22 via a pipe 21*b*. Therefore, after new air from the air cleaner case 40 is supplied to the turbocharger 24 via the pipe 25, is compressed in its compressor and is supplied and cooled to/in the inter-cooler 22 via the pipe 22*a*, the new air is supplied to the engine 20 via the surge tank 41.

Exhaust gas which fulfills the role of turning the turbine of the turbocharger 24 is exhausted into a water muffler 60 via a first exhaust pipe 51, a back flow preventing chamber 52 for preventing the back flow of water in a turnover (the penetration of water into the turbocharger 24 and others) and a second exhaust pipe 53, and is further exhausted into a stream made by the water jet pump 30 from the water muffler 60 via an exhaust gas/waste water pipe 54 and a resonator.

An engine speed sensor that senses engine speed, a steering angle sensor that detects steering angle and a throttle angle sensor that senses an angle of the throttle valve are provided to the engine 20. Besides, a boost pressure sensor that detects boost pressure is provided to the turbocharger 24. The engine speed sensor, the steering angle sensor, the throttle angle sensor and the boost pressure sensor are connected to a controller 100 (engine control unit) mounted in the jet propulsion boat 10.

Measured values sensed by these sensors are regularly output to the controller 100.

The controller 100 is an engine control unit (ECU) that controls the engine 20, the turbocharger 24 and other parts including the fuel injection system and ignition system. The fuel injection system injects fuel under the control of the controller 100. The igniter similarly ignites fuel under the control of the controller 100.

Next, referring to the drawings, the operation of the jet propulsion boat 10 in which the engine control unit equivalent to this embodiment is mounted will be described.

Figure 4:
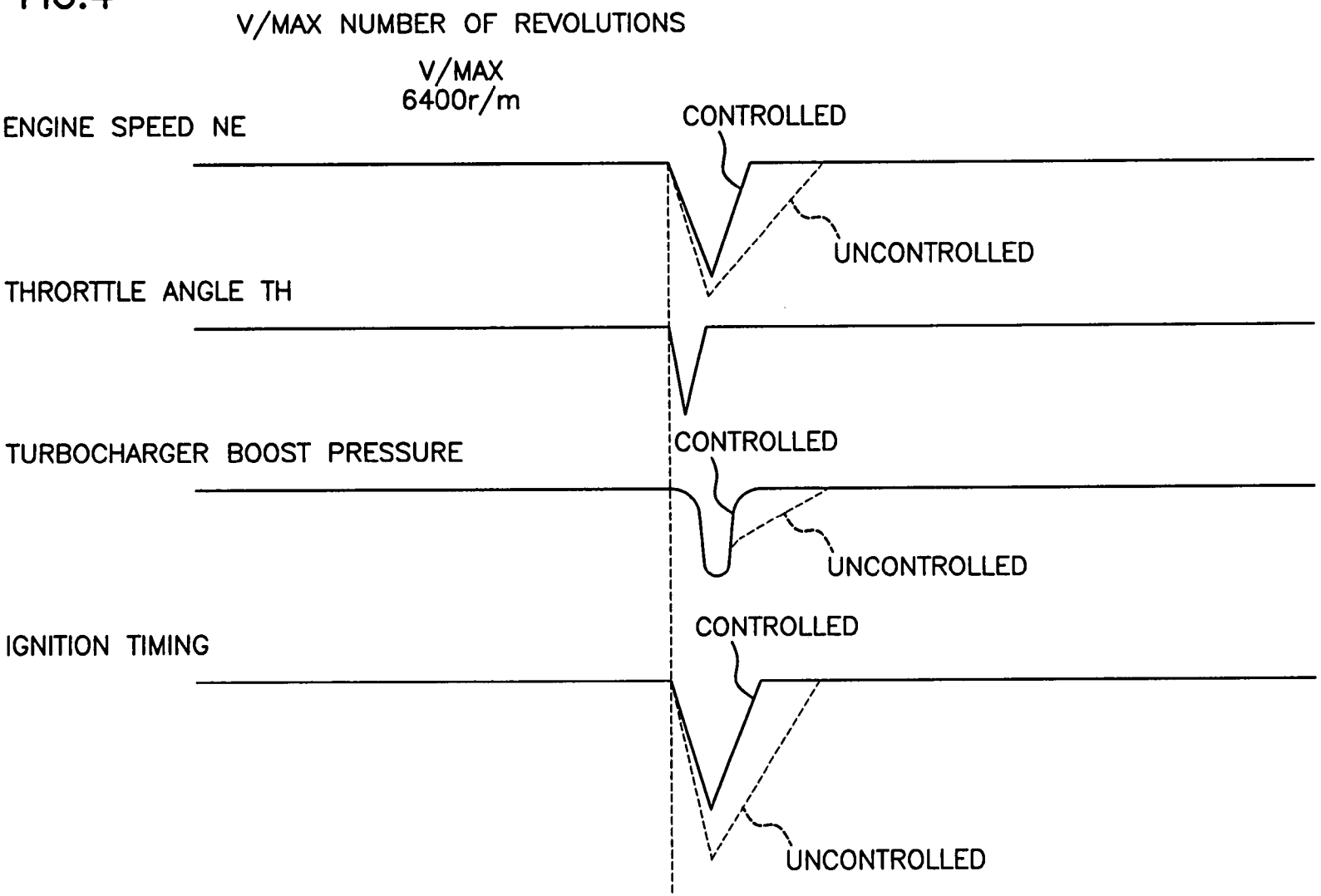
FIG. 4 is a graph mainly showing the variation in time of engine speed and ignition timing.
Figure 5:
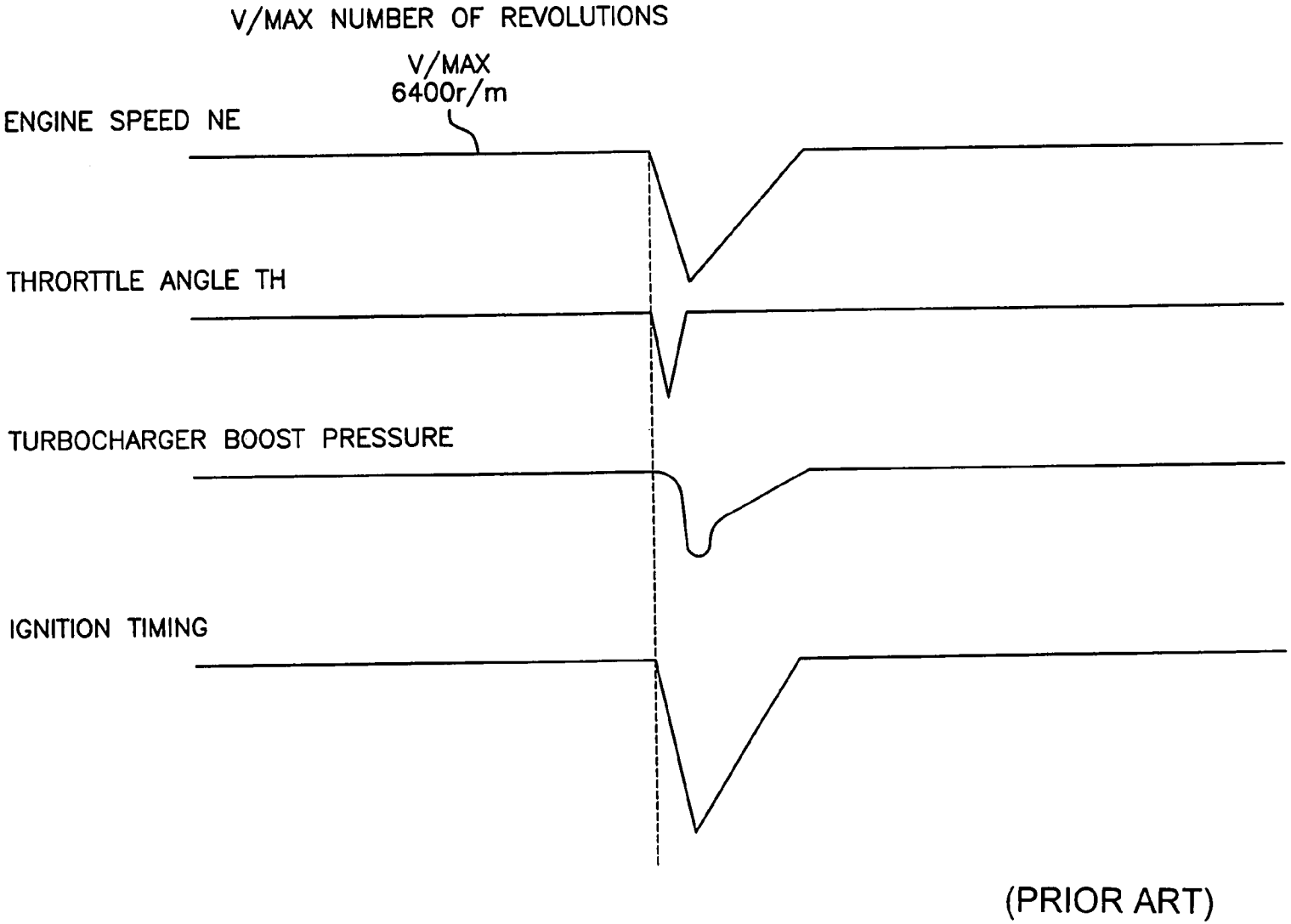
FIG. 5 is a graph showing the conventional type variation in time of engine speed and ignition timing.

FIG. 4 is a graph showing the variation in time of a value of each parameter such as engine speed, a throttle angle, boost pressure and ignition timing in the jet propulsion boat in which the engine control unit equivalent to this embodiment is mounted as in FIG. 5. The y-axis shows a value of the variation in time and a value on the upside of the y-axis is higher. The x-axis shows time.

Suppose that the throttle valve of the engine 20 is held greatly open when a rider grips the steering handlebar 13 provided with the throttle lever. At this time, as shown in FIG. 4, as the throttle (TH) angle of the engine is held at a predetermined value or at an angle equal to or larger than the predetermined value for fixed time, the controller 100 controls the fuel injection system and the igniter based upon a measured value of the throttle angle output by the throttle angle sensor and holds the engine speed in a state of revolution (6400 rpm in FIG. 4) equal to or exceeding the predetermined value for fixed time.

Suppose that the throttle valve of the engine 20 is closed when the rider suddenly releases the grip of the steering handlebar 13 provided with the throttle lever in this state. When the throttle angle of the engine rapidly narrows in short time, the controller 100 makes advance angle control over the ignition timing of the igniter for fixed time using the decrease of a measured value of the throttle angle output by the throttle angle sensor as a trigger. Concretely, the controller 100 detects that the ratio of the decrease of the throttle angle calculated based upon the measured value of the throttle angle output by the throttle angle sensor is equal to or exceeds a predetermined value, corrects so that the ignition timing of the igniter is earlier than ignition timing calculated based upon the engine speed for fixed time and outputs an ignition signal to the igniter. Besides, at this time, the controller 100 controls the quantity of fuel injected by the fuel injection system based upon the result of the correction of the corresponding ignition timing.

The fuel injection system injects fuel under the control of the controller 100 and the igniter ignites fuel according to an ignition signal output by the controller 100 earlier than the top dead center of a piston.

Ignition timing is made earlier by such advance angle control over ignition timing as shown in FIG. 4, compared with a case that no control is made and the rapid decrease of the engine speed is inhibited, compared with the case that no control is made.

When the rider grips the steering handlebar 13 provided with the throttle lever in this state to make the throttle valve of the engine 20 greatly open, the controller 100 calculates the engine speed based upon a measured value of the throttle angle output by the throttle angle sensor and controls the fuel injection system and the igniter so that the engine speed increases.

At this time, as the speed of the engine 20 is high, compared with the case that no control is made, a response from the turbocharger 24 is acquired in a short time lag, the engine speed can be rapidly increased and the jet propulsion boat 10 is easily accelerated again.

As described above, the engine control unit equivalent to this embodiment makes advance angle control over the ignition timing of the engine for fixed time and controls so that the decrease of the engine speed is inhibited for fixed time when the throttle angle of the engine narrows, more concretely the ratio of the decrease of the throttle angle of the engine is equal to or exceeds a predetermined value or the throttle angle of the engine is equal to or less than a predetermined value in case the speed of the engine that drives the water jet pump is held in a state of revolution equal to or exceeding a predetermined value for fixed time and the throttle angle of the engine is held at an angle equal to or exceeding a predetermined value for fixed time.

Therefore, according to the jet propulsion boat mounting the engine control unit equivalent to this embodiment, the responsibility of the boost pressure of the turbocharger can be enhanced in reacceleration and the engine speed reaches a desired value in short time again.

Therefore, effect that a desired acceleration feel is acquired according to the will of the rider who desires reacceleration is acquired.

Referring to the drawings, a second embodiment of the engine control unit according to the invention will be described below. An engine control unit equivalent to this embodiment is different from that in the first embodiment in that it is more focused on how an advance angle correction amount is set in the elapse of time. The description of a part common to that in the first embodiment is omitted and a different part will be described below.

Figure 6:
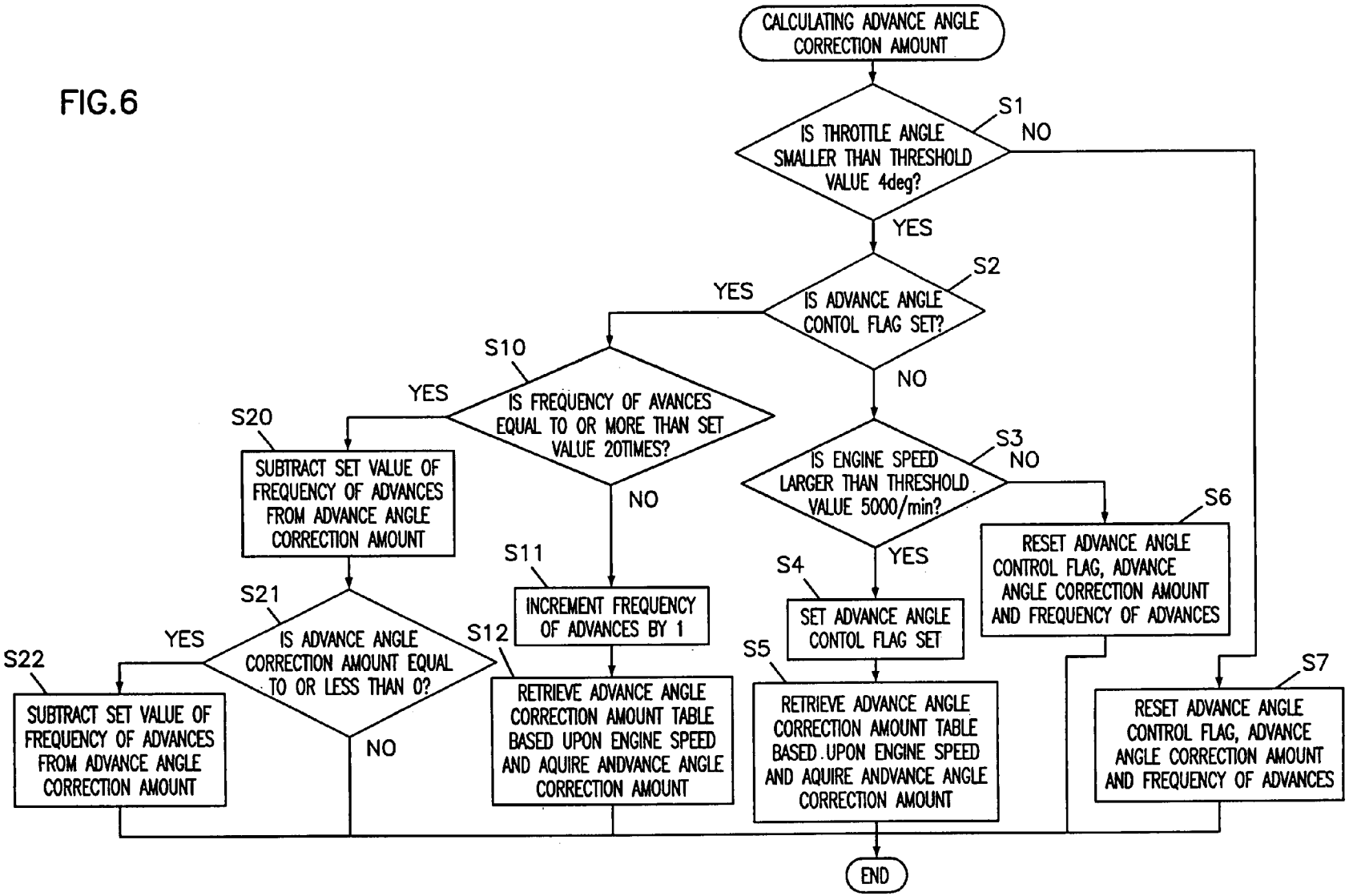
FIG. 6 is a flowchart showing the more concrete flow of advance angle control over ignition timing.

FIG. 6 is a flowchart showing the more concrete flow of the advance angle control of the ignition timing shown in FIG. 4.

Suppose that the throttle valve of the engine 20 is held greatly open when a rider grips the steering handlebar 13 provided with the throttle lever. At this time, as the throttle (TH) angle of the engine is held at a predetermined value or at an angle equal to or larger than the predetermined value for fixed time, the controller 100 controls the fuel injection system and the igniter based upon a measured value of the throttle angle output by the throttle angle sensor and holds the engine speed in a state of revolution equal to or exceeding the predetermined value for fixed time.

Suppose that the throttle valve of the engine 20 is closed when the rider suddenly releases the grip of the steering handlebar 13 provided with the throttle lever in this state. When a throttle angle of an engine rapidly narrows in short time, a controller 100 determines whether an advance angle control flag is set or not using a fact that a measured value of the throttle angle output by a throttle angle sensor is smaller than a threshold value as a trigger (Yes in a step S1 shown in FIG. 6) (a step S2). As the advance angle control flag is reset in an initial flag check (No in the step S2), the controller 100 further determines whether the engine speed is larger than a threshold value or not (a step S3). In this case, as the engine is in a state in which it is revolved at high speed (Yes in the step S3), the controller 100 sets the advance angle control flag (a step S4), retrieves an advance angle correction amount table based upon the engine speed and acquires an advance angle correction amount (a step S5).

In the meantime, in case the throttle angle is equal to or exceeds a threshold value (No in the step S1) and in case the engine speed is equal to or less than the threshold value (No in the step S3), the controller 100 resets the advance angle control flag, the advance angle correction amount and the frequency of advances (steps S6, S7).

Figure 7:
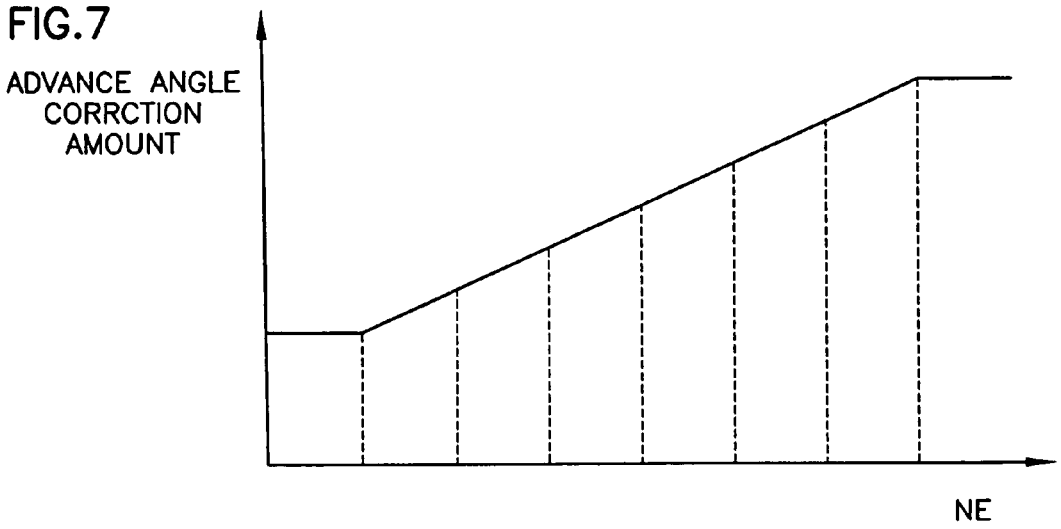
FIG. 7 is a graph showing an advance angle correction amount.

FIG. 7 is a graph showing the advance angle correction amount. In this graph, the x-axis shows engine speed and a value is larger (shows higher speed) on the right side on the x-axis. The y-axis shows the advance angle correction amount of the ignition timing and a value is larger on the upside on the y-axis. The advance angle correction amount has a preset value depending upon engine speed in calculating the correction amount. Concretely, the advance angle correction amount is set to a fixed lower limit value up to a predetermined lower limit engine speed and when the advance angle correction amount exceeds it, it is set to a higher value in proportion to engine speed. Further, when the advance angle correction amount reaches predetermined upper limit engine speed, the succeeding advance angle correction amount is set to a fixed upper limit value.

Figure 8:
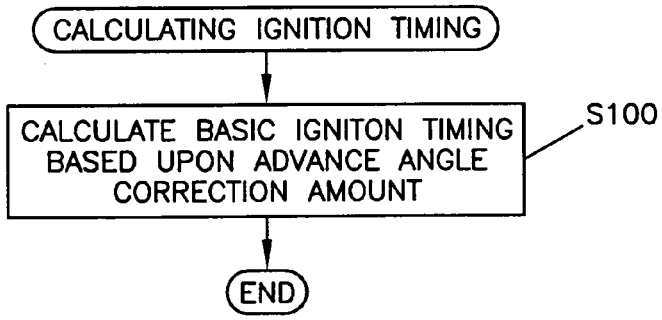
FIG. 8 is a flowchart for calculating ignition timing.

Ignition timing is calculated using the acquired advance angle correction amount of ignition timing (see FIG. 8). That is, the controller 100 calculates basic ignition timing based upon the advance angle correction amount of ignition timing (a step S100 shown in FIG. 8) and outputs an ignition signal to the igniter. At this time, the controller 100 also controls the quantity of fuel injected by the fuel injection system based upon the result of the correction of ignition timing. The fuel injection system injects fuel under control by the controller 100 and the igniter ignites fuel earlier than the top dead center of the piston according to an ignition signal output by the controller 100. Hereby, an advance angle correction amount at initial time is reflected in the basic ignition timing and advance angle control is made over the ignition timing of the igniter for fixed time.

Next, after fixed time elapses, the controller 100 calculates an advance angle correction amount. That is, the controller 100 detects that a measured value of the throttle angle output by the throttle angle sensor is smaller than the threshold value (Yes in the step S1 shown in FIG. 6) and determines whether the advance angle control flag is set or not (the step S2). As the advance angle control flag is already set in the flag check at this time (Yes in the step S2), the controller 100 further determines whether the frequency of advances is equal to or more than a set value or not (a step S10). In the initial determination of the frequency of advances, the frequency is reset and is smaller than the set value (No in the step S10). Therefore, in this case, the controller 100 stores a number incremented by one as the frequency of advances (a step S11), retrieves the advance angle correction amount table based upon engine speed again and acquires an advance angle correction amount (a step S12).

The controller 100 calculates the basic ignition timing based upon the advance angle correction amount of ignition timing again (the step S100 shown in FIG. 8) and outputs an ignition signal to the igniter. At this time, the controller 100 also controls the quantity of fuel injected by the fuel injection system based upon the result of the correction of the ignition timing. The fuel injection system injects fuel under control by the controller 100 and the igniter ignites fuel earlier than the top dead center of the piston according to the ignition signal output by the controller 100. Hereby, an advance angle correction amount after the advance angle control flag is set is reflected in the basic ignition timing and advance angle control is made over the ignition timing of the igniter for fixed time.

When a loop in the step S100 is executed up to the set value of the frequency of advances (Yes in the step S10) in these steps S10 to S12, the controller 100 next subtracts the set value of the frequency of advances from the advance angle correction amount (a step S20). In case an advance angle correction amount after subtraction is zero or less (Yes in a step S21), the controller 100 resets the advance angle control flag, the advance angle correction amount and the frequency of advances (a step S22), calculates the basic ignition timing in case the advance angle correction amount is zero (the step S100 shown in FIG. 8) and outputs an ignition signal to the igniter. At this time, the controller 100 also controls the quantity of fuel injected by the fuel injection system based upon the result of the correction of the ignition timing. The fuel injection system injects fuel under control by the controller 100 and the igniter ignites fuel according to the ignition signal output by the controller 100. Hereby, an advance angle correction amount after the advance angle control flag is reset is reflected in the basic ignition timing and advance angle control over the ignition timing of the igniter is released.

In the meantime, in case an advance angle correction amount after subtraction is still larger than zero (No in the step S21), the controller 100 calculates the basic ignition timing based upon the advance angle correction amount after subtraction (the step S100 shown in FIG. 8) and outputs an ignition signal to the igniter. At this time, the controller 100 also controls the quantity of fuel injected by the fuel injection system based upon the result of the correction of the ignition timing. The fuel injection system injects fuel under control by the controller 100 and the igniter ignites fuel earlier than the top dead center of the piston according to the ignition signal output by the controller 100.

Hereby, an advance angle correction amount at initial time is reflected in the basic ignition timing and advance angle control is made over the ignition timing of the igniter for fixed time.

The loop for subtraction in these steps S1, S2, S10 and S21 is executed until an advance angle correction amount after subtraction is zero or less and after the reset in the step S22, advance angle control over the ignition timing of the igniter is released.

Figure 9:
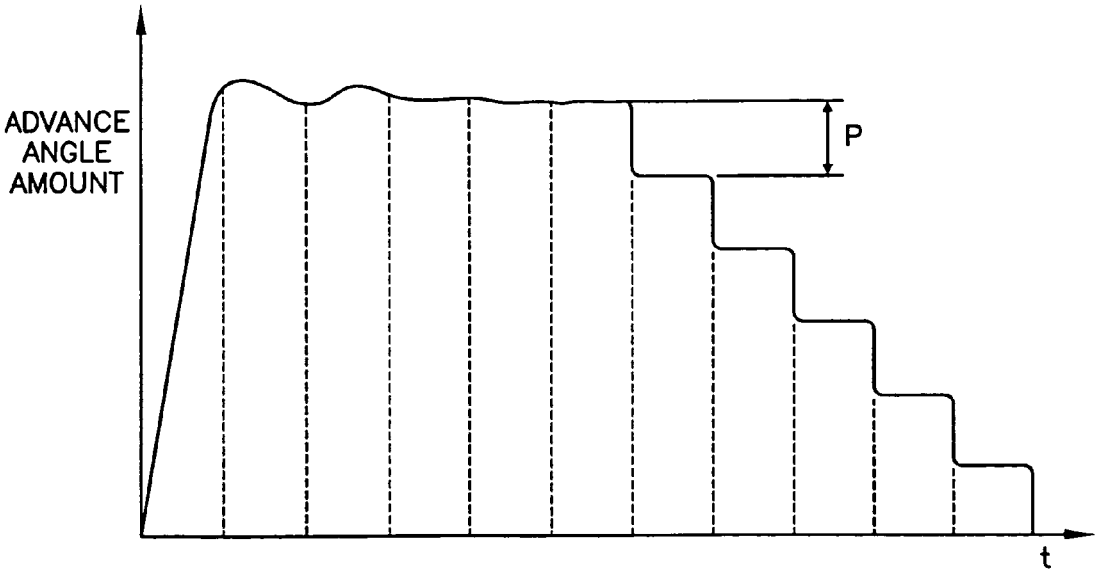
FIG. 9 is a graph showing the variation in time of an advance angle amount of engine ignition timing since a flag is set.

FIG. 9 is a graph showing the variation in time of an advance angle amount of the engine ignition timing since the flag is set. As shown in FIG. 9, the advance angle correction amount table is retrieved based upon engine speed at each time every fixed time up to the set value of the frequency of advances since the flag is set and an advance angle amount after correction is determined. In the meantime, when the frequency of advances reaches the set value, the advance angle correction amount is subtracted by a set value of the frequency of advances every time and when the advance angle correction amount is zero or less, the advance angle control flag is reset.

The ignition timing is gradually restored after it is once made earlier by such fine advance angle control over the ignition timing, compared with the case that no advance angle control is made. Therefore, the rapid decrease of the engine speed is inhibited, compared with the case that no control is made.

When a rider grips the steering handlebar 13 provided with the throttle lever in this state to make the throttle valve of the engine 20 greatly open, the controller 100 calculates engine speed based upon a measured value of the throttle angle output by the throttle angle sensor, controls the fuel injection system and the igniter and enhances engine speed.

At this time, as the speed of the engine 20 is high, compared with the case that no control is made, a response of the turbocharger 24 is acquired in short time lag, the engine speed can be rapidly enhanced and the jet propulsion boat 10 is easily accelerated again.

As described above, in the engine control unit equivalent to this embodiment, when the throttle angle of the engine is equal to or smaller than a predetermined value in a state in which the speed of the engine that drives a water jet pump is held in a state of revolution equal to or exceeding the threshold value, the engine speed is controlled so that the decrease of the engine speed is inhibited by making great advance angle control over the ignition timing of the engine for fixed time and gradually lowering an advance angle amount of the ignition timing up to zero after the fixed time elapses.

Therefore, according to the jet propulsion boat mounting the engine control unit equivalent to this embodiment, the responsibility of the boost pressure of the turbocharger in reacceleration can be enhanced and the engine speed reaches a desired value in short time again.

Therefore, effect that a desired acceleration feel is acquired as the will of the rider who desires reacceleration is acquired.

The embodiment of the invention is described above, however, the invention is not limited to the embodiment and can be suitably transformed in a range of the object of the invention.

The engine control unit 100 can switch ignition timing from a normal mode to an advance angle control mode when a detected engine speed exceeds an engine speed preset value, a detected throttle angle is less than a throttle angle preset value, and a detected steering angle is less than a steering angle preset value.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An engine control unit for a water jet propelled boat comprising:

a throttle angle sensor for sensing detected throttle angle;

an engine speed sensor for sensing detected engine speed;

a memory device for storing an engine speed preset value and a throttle angle present value;

a turbocharger; and a steering angle sensor for sensing detected steering angle;

wherein the engine control unit switches ignition timing from a normal mode to an advance angle control mode when the detected engine speed exceeds an engine speed preset value, the detected throttle angle is less than a throttle angle preset value, and the detected steering angle is less than a steering angle preset value.

2. The engine control unit according to claim 1, further comprising:

a timer adapted to limit the duration of the advance angle control mode.

3. An engine control unit for a water jet propelled boat comprising:

an engine including a user controlled throttle that regulates engine speed, and a turbocharger;

a steering angle sensor for sensing detected steering angle; and means for automatically maintaining engine speed for a set time when the user controlled throttle is moved towards a closed position provided the engine speed exceeds a preset value, wherein the means for automatically maintaining engine speed switches ignition timing from a normal mode to an advance angle control mode when a detected engine speed exceeds the engine seed preset value, a detected throttle angle is less than a throttle angle preset value, and a detected steering angle is less than a steering angle preset value.

* * * * *